United States Patent [19]

Nagano

[11] Patent Number: 4,696,517

[45] Date of Patent: Sep. 29, 1987

[54] DUMPING MECHANISM FOR A DUMPING TOY TRUCK

[75] Inventor: Toshiaki Nagano, Tokyo, Japan

[73] Assignee: Shinsei Kogyo Co., Ltd., Tokyo, Japan

[21] Appl. No.: 699,453

[22] Filed: Feb. 7, 1985

[30] Foreign Application Priority Data

Sep. 26, 1984 [JP] Japan ..... 59-145156[U]
Sep. 26, 1984 [JP] Japan ..... 59-145157[U]

[51] Int. Cl.[4] ..... A63H 17/05

[52] U.S. Cl. ..... 298/1 T; 74/50; 74/566; 267/42; 267/144; 267/153; 267/160; 277/30; 277/212 FB; 298/19 R; 414/915; 446/428

[58] Field of Search ..... 74/50, 566; 267/2, 42, 267/44, 47, 141, 153, 158, 160; 298/1 T, 17 R, 19 R; 414/915, 913; 277/30, 212 FB; 446/428

[56] References Cited

U.S. PATENT DOCUMENTS

| | | | |
|---|---|---|---|
| 1,787,892 | 1/1931 | Bordeaux | 298/19 R |
| 1,912,831 | 6/1933 | Evans | 74/566 X |
| 2,620,208 | 12/1952 | Patch et al. | 277/30 X |
| 3,239,259 | 3/1966 | Dance et al. | 277/212 FB |
| 3,260,013 | 7/1966 | Ryan | 298/19 R |
| 3,650,520 | 3/1972 | Vernon et al. | 267/141 X |
| 3,711,990 | 1/1973 | Pfeilsticker | 446/428 |
| 4,171,920 | 10/1979 | Kramer et al. | 267/153 X |

FOREIGN PATENT DOCUMENTS

| | | | |
|---|---|---|---|
| 848591 | 9/1960 | United Kingdom | 446/428 |

*Primary Examiner*—Robert J. Spar
*Assistant Examiner*—Janice Krizek
*Attorney, Agent, or Firm*—Young & Thompson

[57] ABSTRACT

A dumping mechanism for a dumping toy truck with a rear deck is disclosed, which is provided with a covering element for preventing invasion of dust and gravel through a large hole for a lifting rod, as well as a buffering pad for a bearing shaft for the rear deck and a flexible buffer at the lower end of the lifting rod for absorbing any sudden shock or loading applied by an infant.

4 Claims, 6 Drawing Figures

DUMPING MECHANISM FOR A DUMPING TOY TRUCK

FIELD OF THE INVENTION

This invention relates to a dumping mechanism for a dumping toy truck, particularly in which the dumping mechanism for lifting a rear deck to an inclined position by remote control is protected from invasion of dust and gravel, and from external shocks upon lifting the deck, thereby to protect the mechanism from damage and to ensure its stable operation.

BACKGROUND OF THE INVENTION

In such type of dumping toy truck, a dumping mechanism arranged in a car body has been operated to lift a rear deck through a lifting rod. However, since the lifting rod retractably protrudes from the car body by means of gears rotatable in the mechanism, some oscillating movement must be accommodated in addition to straight movement. In order to absorb the oscillating movement and to ensure smooth operation, the lifting rod is passed through an oblong or oval hole provided in an upper wall of the car body. Such hole having a larger size than a diameter of the lifting rod, there may also pass therethrough dust and gravel when used under bad conditions, which may be deposited on the inner dumping mechanism to obstruct the smooth operation and to cause damage of the mechanism. When the toy truck is handled by an infant, on the other hand, the rear deck may be sometimes obstructed for its lifting movement, thereby to damage operating gears of the mechanism and to disorder delicate adjustment of various components. Such malfunction of the mechanism results in a short-life and uninteresting toy.

Accordingly, an object of the invention is to provide a damping mechanism which is able to tightly seal a hole for passing the lifting rod for preventing invasion of dust and gravel, eliminating damage and disorder of the mechanism, and thus achieving smooth operation.

Another object of the invention is to provide a damping mechanism which is able to alleviate sudden shocks upon the lifting movement of the deck for preventing damage of inner gears and their adjustment, and thus achieving smooth operation.

SUMMARY OF THE INVENTION

In one aspect, the invention provides a damping mechanism for a dumping toy truck, which is mounted in a car body for lifting a rear deck to an inclined position and which includes a lifting rod that protrudes retractably from the car body, characterized in that the car body at its upper wall is provided with a passing means which is convex in the extension direction of the lifting rod and has a hole of longer dimension in the oscillating direction for passing the lifting rod therethrough, and in that the passing means on its concave surface is in contact slidably with a corresponding convex surface of a covering element which consists of a sealing part having a through-hole passing the lifting rod and side walls at either side, each of said side walls being provided with a bearing pin protruding therefrom for swingably supporting said covering element on the dumping mechanism or the car body.

In this aspect of the invention, preferably the lifting rod is fittingly inserted into a guiding tube which is fitted in the through-hole.

In another aspect, the invention provides a dumping mechanism for a dumping toy truck, which is mounted in a car body for lifting a rear deck to an inclined position and in which a lifting rod protrudes retractably from the car body, characterized in that a shaft for lifting the rear deck is supported on a bearing part of the car body through an elastomeric buffering pad which is fitted into the bearing part, and in that the lifting rod at its lower end is provided with a flexible buffer.

In the latter aspect of the invention, preferably the flexible buffer is formed in a closed loop shape which at its supporting portion protruding at right angles to the lifting rod is provided with an opening and is flexible in the moving direction of the lifting rod.

The invention will be described hereinbelow in more detail for its preferred embodiments with reference to the accompanying drawings.

PREFERRED EMBODIMENTS OF THE INVENTION

Figure 1A:
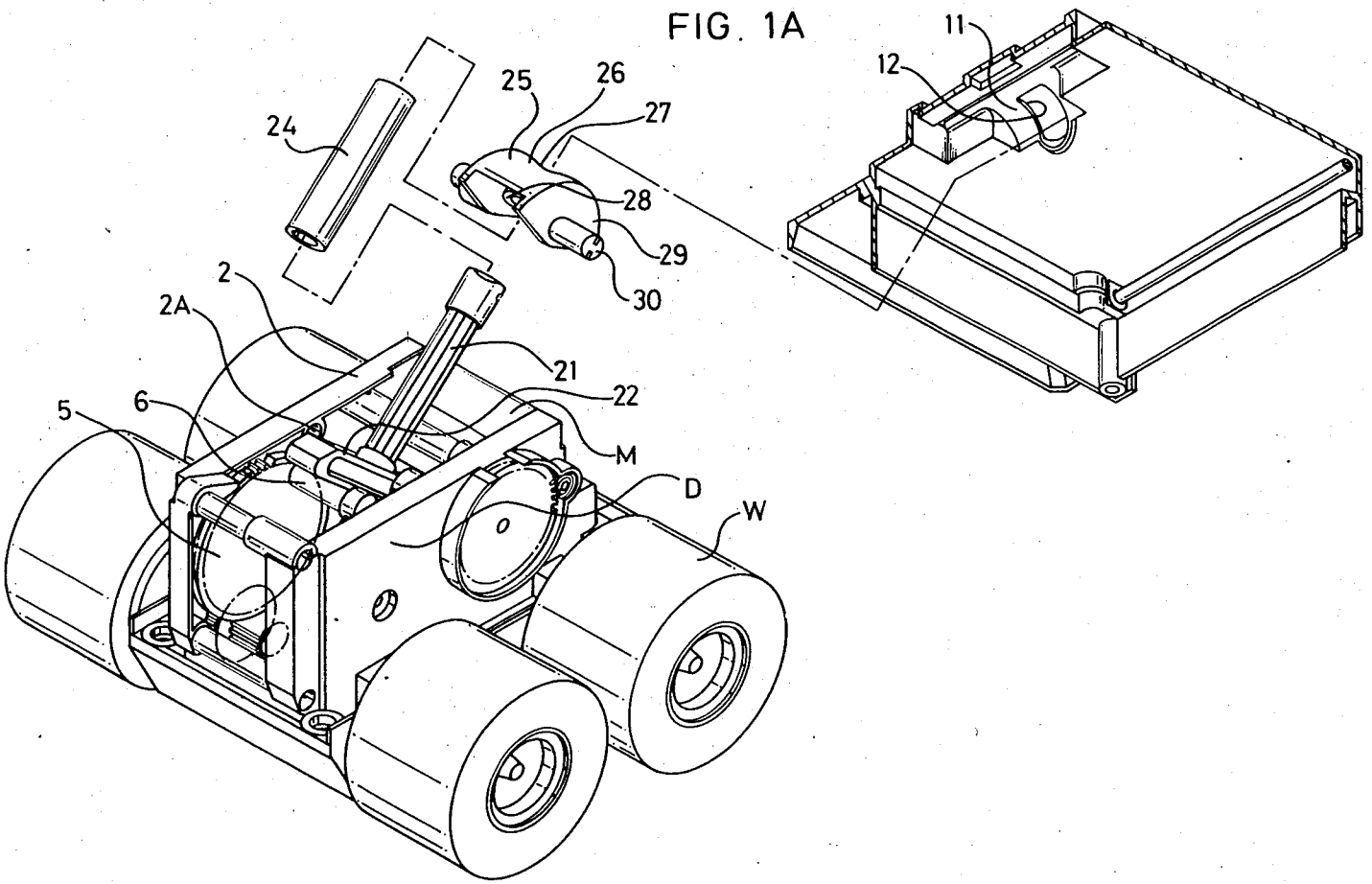
FIG. 1A is a broken perspective view of one embodiment of the dumping mechanism according to the invention.

In the drawings reference T represents a dumping toy truck which may be operated for its running movement and speed by a radio control system for selecting manual switches (not shown) and further operated for its lifting movement of a rear deck P by selecting the same switches. The running movement of the toy truck T and the lifting movement of the rear deck P are remote-controlled by selecting the switches for driving a motor M of a dumping mechanism D arranged in a car body 1. In more detail, the dumping mechanism D includes a box frame 2 to which are attached the motor M, a reduction mechanism consisting of a gear train, a swingable switching gear 3, wheels W, and an externally and manually operatable switch. Then, operation modes may be selected by manually operating a radio controller for supplying signals. In this case, power is transmitted from a large gear on the motor side to a small gear on the wheel side during high speed operation, but from the small gear on the wheel side to the large gear on the motor side during low speed operation.

Figure 2:
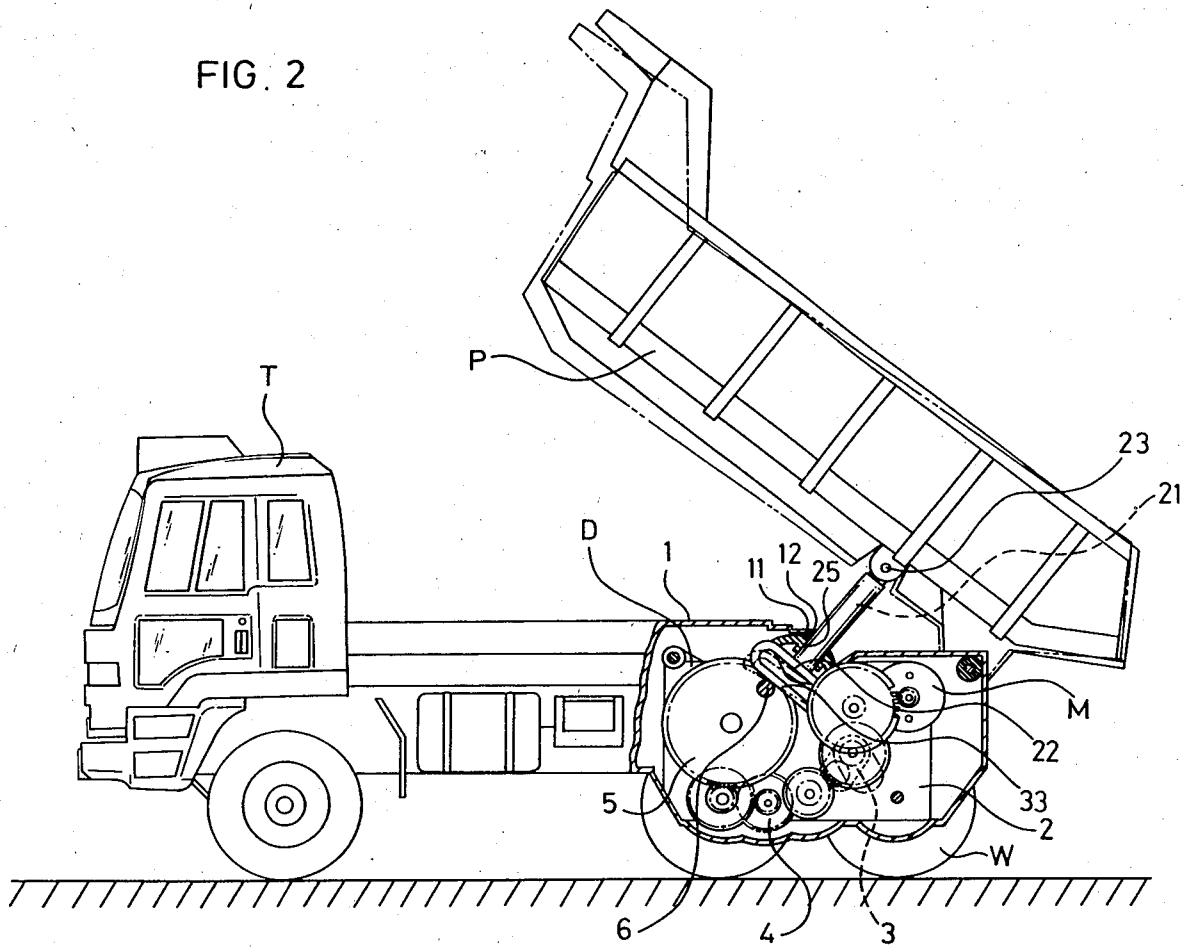
FIG. 2 is a side view of the dumping toy truck with the main portions in section when the rear deck has been lifted to its inclined position.
Figure 3:
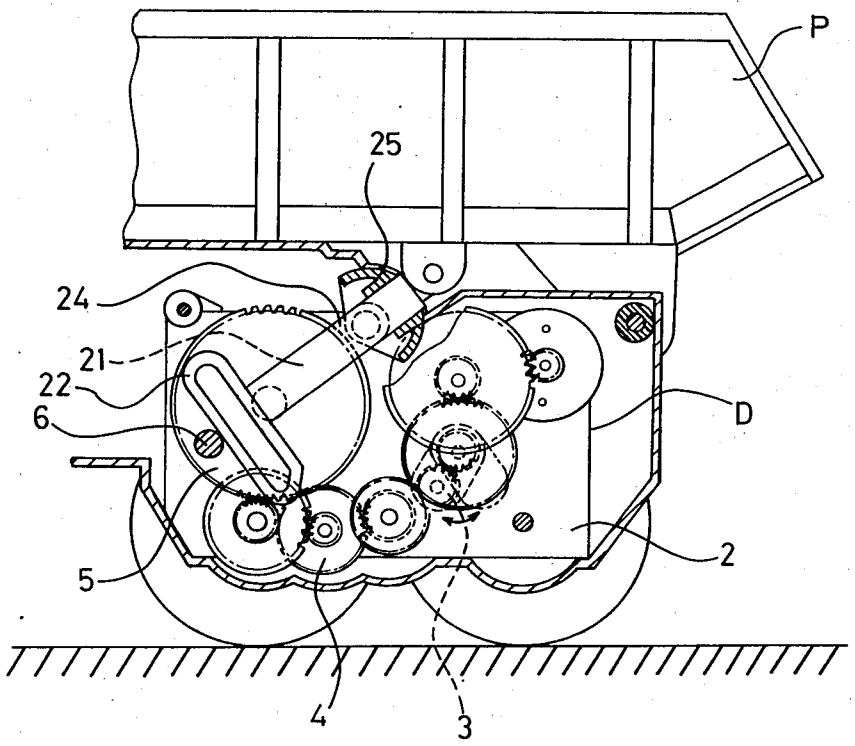
FIG. 3 is a partsectional side view of main portions of the dumping toy truck when the deck is restored to its horizontal position.

As shown in FIGS. 2 and 3, during the dumping operation the gear 3, which is swingable by the rotational inertia of the motor M, may allow the forward running by a signal from the radio controller (a gear train for this running operation is not shown), while a reverse rotational force by a signal for the backward running may allow the reversely swinging gear 3 to cause a lifting rod 21 to be extended from the car body 1 through a reduction gear train 4, a lifting gear 5 and a supporting arm 6, thereby to lift the rear deck P. The lifting rod 21 at its upper end is connected through a pivot 23 to a bottom face of the deck P which is placed on the rear of the car body 1. When the swinging gear 3 is meshed with the reduction gear train 4, its rotational force is transmitted through the reduction gear 4 to the lifting gear 5 while reducing the rotational rate gradually. The rotation of the gear 5 causes the supporting arm, which is arranged between the gear 5 and a freely rotatable plate opposite thereto, to rotate around a shaft of the gear 5. On the supporting arm 6 is placed a supporting portion 22 that protrudes at right angles from the lower end of the lifting rod 21. Rotation of the supporting arm 6 enables the lifting rod 21 to be extended from the car body 1 by the supporting portion 22 which is sliding on the supporting arm 6, thereby to lift the rear deck P to the inclined position.

Figure 4:
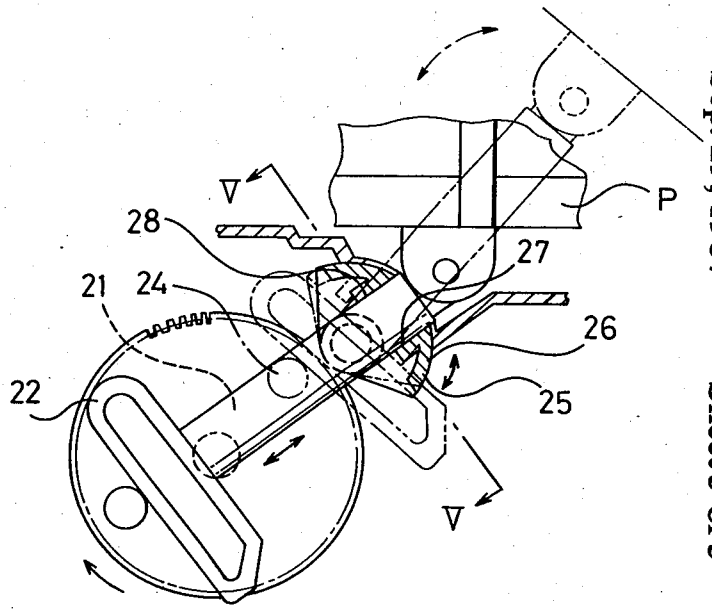
FIG. 4 is a sectional side view of main portions of the dumping mechanism.
Figure 5:
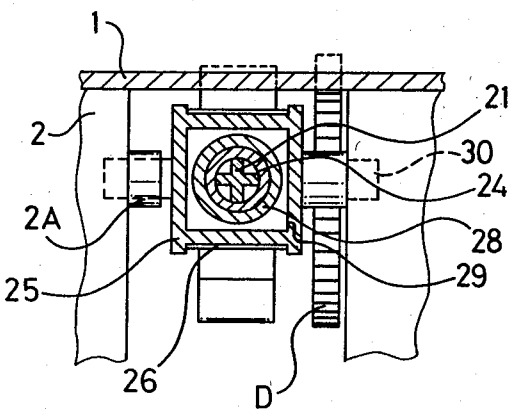
FIG. 5 is a sectional view taken along the line V—V in FIG. 4.

At the rear of the car body 1 containing the dumping mechanism (which is associated with the running operation), the car body 1 at its upper wall is provided with a passing means 11 which is convex in the extension direction of the lifting rod 21 and has a hole 12 of longer dimension (namely, elongated) in the oscillating direction for passing the lifting rod 21 therethrough. As described previously, since the protrusion of the lifting rod 21 from the car body 1 may be achieved by rotation of the gear 5 and since the lifting rod 21 may move axially with the slight oscillator movement depending on the lifting angle as shown in FIG. 4, the passing hole 12 may be elongated in the oscillating direction of the lifting rod 21 sufficiently to allow for this oscillatory movement.

Furthermore, a covering element 25 for sealing the hole 12 is supported in sliding contact with the passing means 11 so as to be adapted to be swingably to follow the oscillatory movement of the lifting rod 21. The covering element 25 is formed in a convex shape at its outer circumference for ensuring the sliding-contact with the concave face of the passing means 11 and is provided with a sealing plate 26 having a hole 27 for passing the lifting rod 21 therethrough. The sealing plate 26 at either of its ends is provided with vertical side walls 29, from each of which protrudes a support pin 30 for swingably correcting the covering element 25 to the dumping mechanism D or the car body 1. The hole 27 in the sealing plate 26 is circular corresponding to the cross-section of the lifting rod 21, while the covering element 25 consisting of the sealing plate 26 and the side walls 29 is substantially half-cylindrical. When the lifting rod 21 is passed through both the hole 27 in the covering element 25 and the hole 12 in the passing means 11, the outer circumference of the sealing plate 26 is sealing and slidably in contact with the concave face of the passing means 11, thereby to enable the covering element 25 to swing while keeping the sealing contact.

In the embodiment as illustrated, a securing tube 28 of a predetermined length protrudes from the sealing plate 26, which communicates with the through-hole 27. Thus, the lifting rod 21 may be prevented from rattling against the covering element 25, thereby to ensure the smooth oscillating movement of the latter.

Furthermore, the lifting rod 21 is inserted into a guiding tube 24 which is fitted to the hole 27 for allowing the lifting rod 21 to slide smoothly through the hole 27 and the tube 28, thereby to facilitate the movement of the lifting rod 21.

The oscillating movement of the covering element 25 is facilitated by pins 30 protruding from the side walls 29 of the covering element 25, each of which pins 30 is supported by a bearing 2A arranged on the frame 2 of the dumping mechanism D. Thus, the covering element 25 may be integrally incorporated into the dumping mechanism D, thereby to improve its function. Alternatively, the covering element 25 may be supported on any part of the car body 1 so long as the sealing plate 26 may be in slidable contact with the passing means 11 during the lifting and oscillating movement of the lifting rod 21.

Thus, in the embodiment as described hereinabove, when the lifting rod 21 is moved with oscillating movement through the large elongated hole 12, the covering element 25 may swing correspondingly to enable its sealing plate 26 to seal the excessive portion of the large hole 12, thereby to prevent dust and gravel from being introduced into the car body 1 and to eliminate the danger of malfunction or damage of the dumping mechanism D. Further, the covering element 25 at its outer circumference (or the sealing plate 26) is convex corresponding to the concave shape of the inner circumference of the passing means 11, thereby to facilitate the sliding movement while maintaining the sealing contact, and thus to ensure the smooth movement of the dumping mechanism.

Figure 1B:
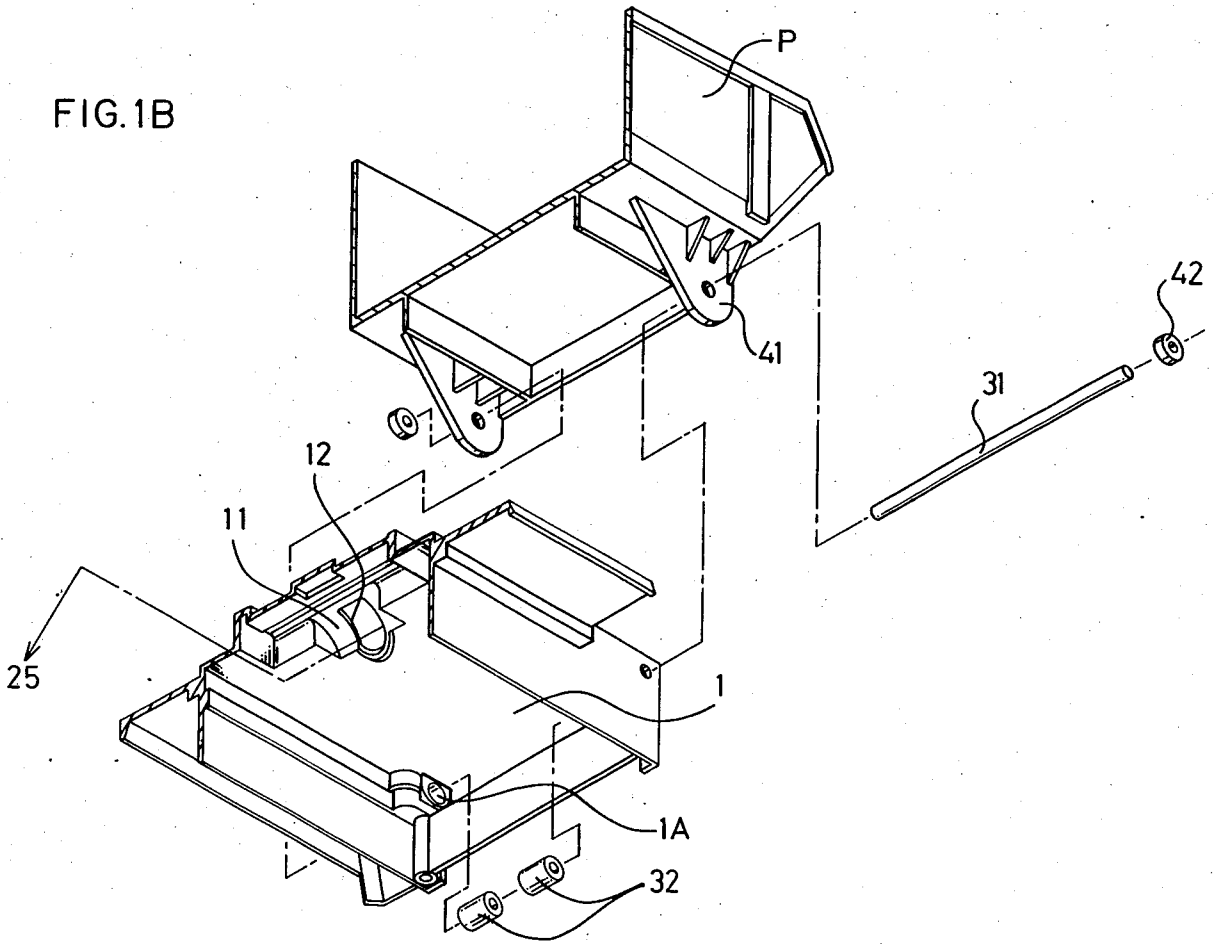
FIG. 1B is a broken perspective view of another embodiment of the dumping mechanism according to the invention.

In another embodiment of the dumping mechanism according to the invention, the rear deck P is movable by means of a shaft 31 supported by bearings 1A at the rear of the car body 1, as shown in FIG. 1B. More particularly, the car body 1 at its either side wall in the rear is provided with bearings 1A of a cylindrical shape, while the rear deck P at its rear bottom is provided with vertically protruding pieces 41. The shaft 31 is inserted through holes of the protruding pieces 41 into the bearings 1A and is fixed by stoppers 42. In each bearing 1A is arranged a buffering pad 32 of an elastic material, such as rubber, into which is passed the shaft 31. An outer diameter of the pad 32 corresponds to an inner diameter of the bearing 1A, through a center cylindrical hole of pad 32 is passed the shaft 31 so as to ensure free rotation of the latter.

As shown in FIG. 2, the lifting rod 21 at its lower end is provided with a flexible buffer 33 for allowing the total length of the lifting rod 21 to be shortened when any loading or shock is applied in the axial direction of the lifting rod 21. The buffer 33 is in a closed loop shape, as shown in FIG. 4, so as to be flexible in the axial direction of the lifting rod 21 and is placed on the supporting arm 6 of the gear 5 for following the rotation of the gear 5. As illustrated, the lifting rod 21 is connected at right angles to a flexible buffer 33 in the substantial T shape. Thus, the loading or shock applied axially to the lifting rod 21 may be absorbed by the flexibility of the buffer 33. For this purpose, the buffer 33 has an opening of an oval shape but not limited thereto, provided that the flexibility of the buffer 33 is available in the axial direction of the lifting rod 21.

In this embodiment, even if the sudden loading or shock is applied to the rear deck P through mishandling by an infant, the shaft 31 supporting the deck P is urged against the pad 32 with a high frictional force and discontinues its rotation, thereby to prevent damage of the shaft 31 and the bearing 1A. Furthermore, the sudden shock applied axially to the lifting rod 21 may be absorbed by the flexibility of the buffer 33 provided at the lower end of the lifting rod 21. In brief, the shock on the rear deck P in its inclined position is taken up by the frictional action between the shaft 31 and the pad 32 as well as the elastic deformation of the pad 32, while the shock applied axially to the lifting rod 21 is absorbed by the elastic deformation and the flexibility of the buffer 33.

Thus, in accordance with the invention as described hereinabove, the dumping mechanism may be protected from the invasion of dust and gravel by means of the covering element which follows the oscillatory movement of the lifting rod for sealing the through-hole of the passing means, thereby to avoid the damage and disorder of the mechanism with a simple construction of low cost. Furthermore, the dumping mechanism may be protected from sudden shock or loading by the pad 32 and the buffer 33 as described hereinabove, thereby to prevent damage of the gears in the mechanism and thus to ensure the long life of the toy with a simple construction of low cost.

What is claimed is:

1. A dumping mechanism for a dumping toy truck, which is mounted in a car body for lifting a rear deck to an inclined position and which comprises a lifting rod that extends retractably from the car body, characterized in that the car body at its upper wall is provided with a passing means whose exterior surface is convex in an extension direction of the lifting rod and has a hole of longer dimension in an oscillating direction for passing the lifting rod therethrough, and in that the passing means has an interior concave surface which is slidably in contact with a corresponding convex surface of a covering element which consists of a sealing part having a through-hole for passing the lifting rod and side walls at either side of the sealing part, each of said side walls being provided with a bearing pin protruding therefrom for swingably supporting said covering element on the toy truck, the lifting rod being movable in the extension direction through said hole and said through-hole.

2. A dumping mechanism according to claim 1, wherein the lifting rod is fittingly inserted into a guiding tube which is fitted in the through-hole.

3. A dumping mechanism for a dumping toy truck, which is mounted in a car body for lifting a rear deck to an inclined position, a lifting rod for lifting the rear deck, the lifting rod being pivotally interconnected at its upper end with the rear deck and at its lower end carrying a flexible buffer in the form of a closed elongated loop extending at right angles to the lifting rod, the closed loop having an opening elongated in a direction perpendicular to the lifting rod, the closed loop being flexible in an extension direction of the lifting rod, a lifting gear mounted for rotation in the car body, a motor for rotating the lifting gear, the lifting gear carrying an eccentric supporting arm which bears slidably on an exterior portion of the closed loop opposite the lifting arm and which, upon rotation of the lifting gear, slides with oscillatory motion along said exterior portion of said closed loop thereby to impart reciprocatory movement to the lifting arm.

4. A dumping mechanism as claimed in claim 3, and a pair of brackets extending downwardly from said rear deck, a shaft passing through said brackets and pivotally connecting said brackets with bearings carried by said car body, and cylindrical buffer pads in said bearings surrounding said shaft for buffering a load on said shaft.

* * * * *